US007286149B2

(12) United States Patent
Peeters

(10) Patent No.: US 7,286,149 B2
(45) Date of Patent: Oct. 23, 2007

(54) DIRECT XEROGRAPHY SYSTEM

(75) Inventor: Eric Peeters, Fremont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 102 days.

(21) Appl. No.: 11/013,055

(22) Filed: Dec. 14, 2004

(65) Prior Publication Data

US 2006/0125905 A1 Jun. 15, 2006

(51) Int. Cl.
*B41J 2/41* (2006.01)

(52) U.S. Cl. ..... 347/141; 399/3

(58) Field of Classification Search ..... 347/112, 347/114, 141, 142, 147, 151; 399/2, 3; 118/621, 118/624, 625
See application file for complete search history.

(56) References Cited

U.S. PATENT DOCUMENTS

| | | | | |
|---|---|---|---|---|
| 3,624,661 | A | 11/1971 | Shebanow et al. | |
| 4,118,610 | A | 10/1978 | Purssell et al. | |
| 4,409,603 | A | 10/1983 | Goffe | |
| 4,969,759 | A | 11/1990 | Suzuki et al. | |
| 5,164,740 | A | 11/1992 | Ivri | |
| 5,237,346 | A | 8/1993 | DaCosta et al. | |
| 5,613,861 | A * | 3/1997 | Smith et al. | 439/81 |
| 5,812,159 | A | 9/1998 | Anagnostopoulous et al. | |
| 5,821,962 | A | 10/1998 | Kudo et al. | |
| 5,909,230 | A | 6/1999 | Choi et al. | |
| 6,007,630 | A * | 12/1999 | Pletcher et al. | 118/624 |
| 6,074,688 | A * | 6/2000 | Pletcher et al. | 427/2.14 |
| 6,176,629 | B1 | 1/2001 | Suzuki et al. | |
| 6,183,055 | B1 | 2/2001 | Kanematsu et al. | |
| 6,290,510 | B1 | 9/2001 | Fork et al. | |
| 6,338,547 | B1 | 1/2002 | Silverbrook | |
| 6,362,845 | B1 | 3/2002 | Genovese | |
| 6,459,855 | B1 | 10/2002 | Kosaka et al. | |
| 6,473,107 | B2 | 10/2002 | Koga et al. | |
| 6,515,692 | B2 | 2/2003 | Koga et al. | |
| 6,518,990 | B2 | 2/2003 | Koga et al. | |
| 6,618,065 | B2 * | 9/2003 | Koga et al. | 347/141 |
| 6,646,663 | B2 | 11/2003 | Kamoshida et al. | |
| 6,650,349 | B2 | 11/2003 | Koga et al. | |
| 6,661,442 | B2 | 12/2003 | Koga et al. | |
| 6,669,334 | B1 | 12/2003 | Silverbrook | |

(Continued)

FOREIGN PATENT DOCUMENTS

| | | |
|---|---|---|
| DE | 10030872 | 2/2001 |

(Continued)

OTHER PUBLICATIONS

Bartscher, G., Cormier, S. O., Lyness, R., Schein, L. B.: Comparison Of The Electric Field Of Electrophotography And Contact Electrography, Journal Of Electrostatics vol. 53, www.elsevier.com/locate/elstat, Apr. 23, 2001, pp. 295-310.

*Primary Examiner*—Huan Tran
(74) *Attorney, Agent, or Firm*—Kent Chen

(57) ABSTRACT

A system for printing is described. The system uses at least one cantilever, and more typically a plurality of cantilever to transfer charge, either to or from a dielectric surface. The resulting charge distribution represents an image. Toner deposited over the dielectric surface is attracted to the charged portions of the dielectric. Thus the toner also forms the image. The toner image is then transferred and affixed to a printing surface.

26 Claims, 5 Drawing Sheets

U.S. PATENT DOCUMENTS

| | | | | |
|---|---|---|---|---|
| 6,750,891 | B2 | 6/2004 | Kamoshida et al. | |
| 6,933,165 | B2 | 8/2005 | Musolf et al. | |
| 2002/0142035 | A1* | 10/2002 | Abrams et al. | 424/473 |
| 2003/0016277 | A1 | 1/2003 | Hawkens et al. | |
| 2003/0022470 | A1 | 1/2003 | Liu et al. | |
| 2003/0117478 | A1 | 6/2003 | Koga et al. | |
| 2003/0119220 | A1 | 6/2003 | Micak et al. | |
| 2003/0202735 | A1* | 10/2003 | Dunec et al. | 385/16 |
| 2003/0211229 | A1 | 11/2003 | Reeves | |
| 2005/0088468 | A1 | 4/2005 | Clark | |
| 2006/0125900 | A1 | 6/2006 | Peeters | |

FOREIGN PATENT DOCUMENTS

| | | | |
|---|---|---|---|
| DE | 10044908 | | 4/2001 |
| DE | 10030163 | | 1/2002 |
| DE | 10030164 | | 1/2002 |
| DE | 10030165 | | 1/2002 |
| DE | 10030166 | | 1/2002 |
| DE | 10030171 | | 1/2002 |
| DE | 10030178 | | 1/2002 |
| DE | 10030180 | | 1/2002 |
| DE | 10124587 | | 1/2002 |
| DE | 10124588 | | 1/2002 |
| DE | 10124589 | | 1/2002 |
| JP | 09300705 | A | 11/1997 |
| WO | WO 2004/044552 | A2 | 5/2004 |

* cited by examiner

DIRECT XEROGRAPHY SYSTEM

CROSS REFERENCE TO RELATED APPLICATIONS

Reference is made to the following commonly assigned, copending patent application, U.S. patent application Ser. No. 11/012,912 filed on the same day, entitled Direct Xerography. The disclosure of this patent application is hereby incorporated by reference in its entirety.

BACKGROUND

Xerographic processes were first used in the 1930s by Chester Carlson to reproduce images. In the 1960s, Xerox Corporation produced the first commercial photocopier based on Xerographic principles, the Xerox-914. In the 1970s, Xerox Palo Alto Research Center (PARC) used many of the same principles to develop the laser printer.

Normal Xerographic laser printing creates a charge pattern on a photoreceptor. To create the charge pattern, a corotron charges all of the pixels on a photoreceptor. A scanned laser beam or laser beams discharge selected photoreceptor pixels. After completion, a charge distribution representing an image remains on the photoreceptor.

The photoreceptor charge distribution is exposed to toner particles. Charged photoreceptor pixels attract toner particles. The resulting photoreceptor toner distribution substantially matches the charge distribution. A paper brought into contact with the photoreceptor receives the toner from the photoreceptor. Heat and fuser fixes the toner in position on the paper.

One problem with the Xerographic laser printing system is that the laser scanning system is delicate and expensive. The optics used to precision scan and direct the laser beam to each pixel represents a significant barrier to allowing laser printers to compete with ink jet printers on price.

Thus a more inexpensive method of charging and discharging a photoreceptor is needed.

SUMMARY

A method of depositing a material is described. The method includes moving a cantilever to determine a charge distribution on a dielectric surface. The charge distribution substantially determines the distribution of the material deposited over the dielectric surface.

In one embodiment, the material is used in printing applications. In printing applications, the material may be a toner deposited on a dielectric and subsequently transferred to a printing surface where the toner is affixed. In alternate embodiments, the material is a biological agent such as a medication to be dispensed.

DETAILED DESCRIPTION

An improved method of distributing materials, usually marking materials used in printing system is described. The system uses at least one cantilever, and more typically an array of cantilevers, that places or removes charge from small regions, "pixel regions", of a dielectric. As used herein, pixels are tiny units of area on either a printed image or a dielectric template that, when combined with other pixels, forms a representation of an image. The representation may be a charge distribution or a toner distribution.

As used herein, the "materials" distributed may be a solid, a powder, a particulate suspended in a liquid or a liquid. Typically, the "material" is a marking material meaning a material that has a different color then the color of the surface to which the material will be affixed. In a typical example, the marking material is a black toner that is to be affixed to a white sheet of paper. The material may also be a biological sample that is deposited in a dosage on a product for administering to a patient, such as a pill or capsule. For convenience, the specification will describe the system used in printing/marking systems, although it should be understood that the system for controlling the distribution of toner may also easily control the distribution of other products, such as pharmaceutical and biological products. As used herein, "image" is broadly defined to include, text, characters, pictures, graphics or any other graphic that can be represented by an ink or charge distribution.

In the described improved printing system, a cantilever adjusts a charge distribution over a dielectric template. The charge attracts toner resulting in a toner distribution that approximately matches the charge distribution. Thus the toner image forms an image that approximately matches the charge defined image.

In one embodiment, the dielectric template serves as the final printed surface. In an alternate embodiment, the dielectric template serves as a platen and the toner image is eventually transferred from the platen to a second surface. Often the second surface is a sheet of paper. Heat, pressure and/or chemicals affix the toner image to the second surface.

Figure 1:
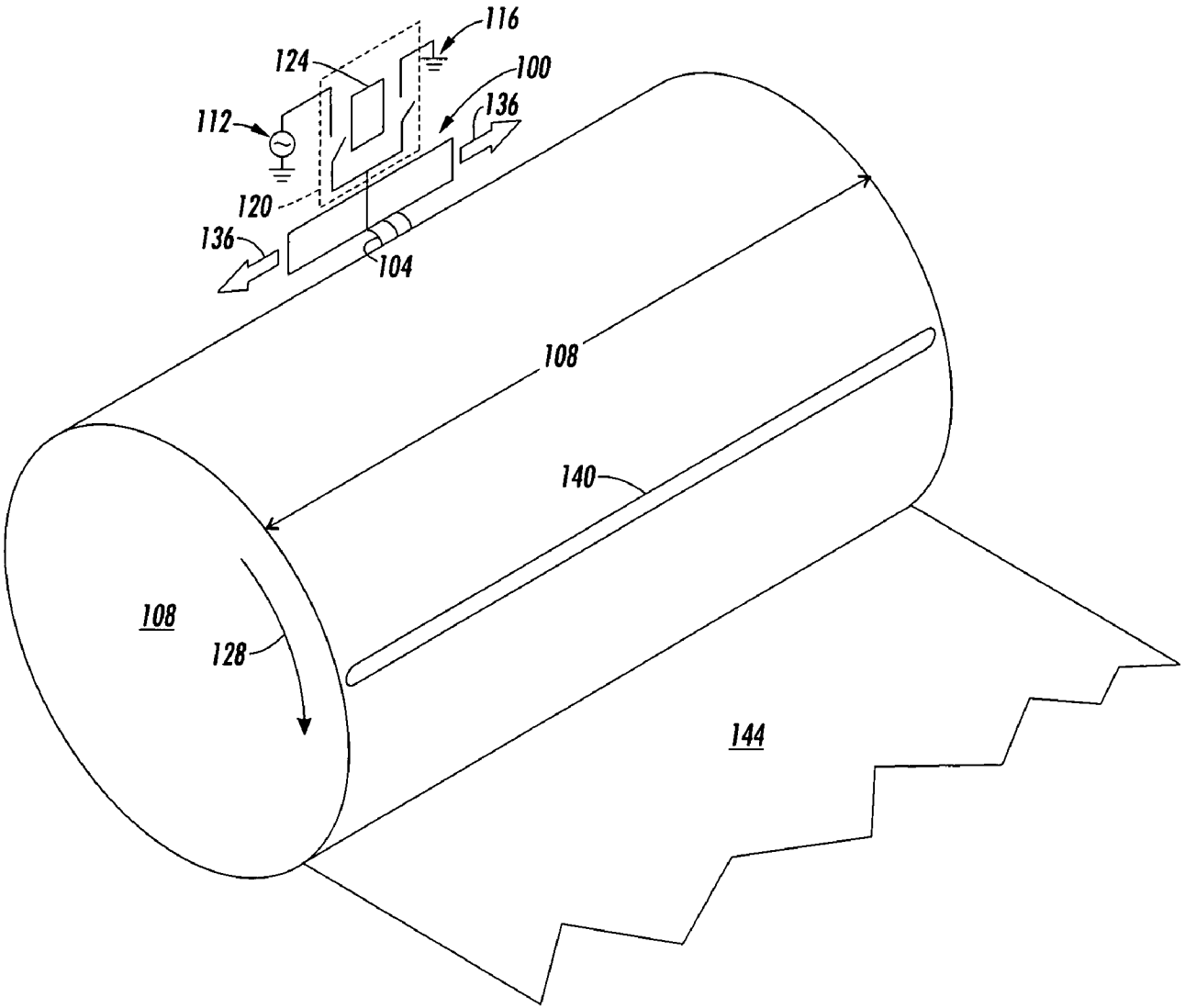
FIG. 1 shows a side view of one embodiment of a direct xerographic printing system.

FIG. 1 shows a side view of an example direct xerographic print system 100. In FIG. 1, a cantilever 104 moves to contact a dielectric drum 108. Drum 108 surface is a dielectric that retains charge, has a high breakdown voltage (such that voltage does not easily leak across the drum surface) and is durable (to withstand printing forces). An example of a typical material for the surface of dielectric drum 108 is aluminum oxide, although many materials are possible.

Cantilever 104 couples pixels on dielectric drum 108 surface to either a charge source 112 or ground 116. A control circuit 120, which may include a processor 124, switches the cantilever between charge source 112 and ground 116. Control circuit 120 also controls the raising and lowering of cantilever 104 to contact rotating drum 108.

Arrow 128 indicates the rotation of drum 108. A corotron places a charge on every drum 108 surface pixel. The charge may be either a positive charge or a negative charge, the toner used determines the actual charge polarity used.

As the drum rotates, control circuit 120 determines what areas or which pixels of an image should not receive toner, hereinafter "clear pixels". Cantilever 104 removes charge from the clear pixels. When a clear pixel is under a tip of cantilever 104, control circuit 120 couples the clear pixel to ground 116 via cantilever 104. Any charge that may exist on the clear pixel transfers from the pixel, through cantilever 104 to ground 116. Control circuit achieves the coupling by either (1) lowering an electrically grounded cantilever or (2) by electronically grounding an already lowered cantilever.

During printing, at least one cantilever should be able to access every area of the drum that undergoes printing. In one implementation, a small number of cantilevers move across the drum in a direction indicated by arrow 136. Alternatively, a large number of cantilevers may span the width of drum 108 eliminating the need for cantilever movement across the drum width.

After cantilevers remove charge from clear pixels, the remaining charge distribution on drum 108 forms an image. A toner deposition mechanism 140 deposits toner 132 onto drum 108. The toner itself may be made from a variety of materials such as polyester. A variety of toners are available commercially from Xerox Corporation of Stamford, Conn. In one embodiment, the toner particles are charged such that charged portions of drum 108 attract toner particles. Toner particles do not adhere to uncharged or "clear" pixels. Thus the toner distribution over drum 108 approximately matches drum 108 surface charge distribution.

Drum 108 surfaces serves as a template or platen that prints the image. As drum 108 rotates, drum 108 contacts a surface to be printed, typically a sheet of paper 144. The toner pattern on drum 108 is transferred to paper 144. To facilitate toner transfer, paper 144 may also be charged. Thus the charge distribution or "charge image" formed by cantilever 104 is transferred as a toner image onto paper 144. Heat and/or chemicals affix the toner to paper 144.

Although the previous description describes a system in which a charge is placed by a corotron and then removed by a plurality of cantilevers, alternate embodiments are possible. For example, instead of using an initially corotron charged surface, an initial charge free dielectric surface may be used. Cantilevers place charge on every pixel that should receive toner. Thus instead of removing charge from clear areas, the cantilevers deposit charge on printed areas. In other printer implementations, cantilevers address every pixel, either placing or removing charge. Cantilever addressing of every pixel makes it unnecessary to either add or remove charge prior to cantilever printing.

Figure 2:
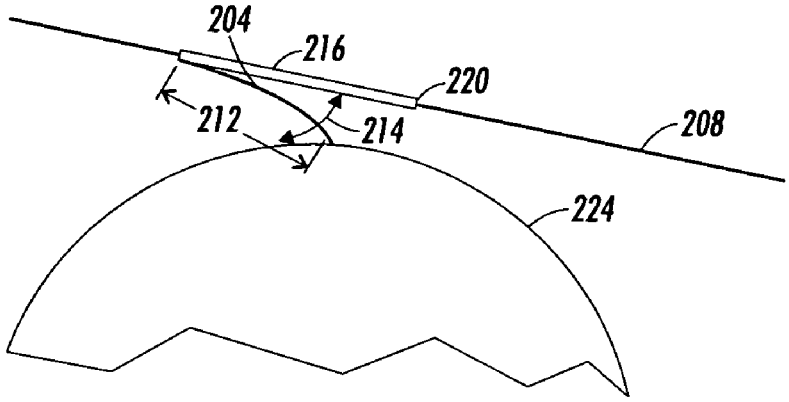
FIG. 2 shows an expanded cross sectional side view of one embodiment of a cantilever structure for the printing system of FIG. 1.

FIG. 2 shows an expanded cross sectional side view of one embodiment of a cantilever structure. In FIG. 2, a cantilever 204 is formed on a substrate 208. Cantilever 204 typically has very small dimensions, less than 2000 microns in length 212. The cantilever flexes to rapidly move through arc path 214. In one embodiment, cantilever 204 is a stressed metal material formed on a printed circuit board (PCB) or glass substrate.

An actuator 216 moves cantilever 204 between an upward point 220 and a drum surface 224 to be printed. In one embodiment, actuator 216 is a low powered piezo-actuated actuator that moves the cantilever. Such piezo-electrics typically consume less power than piezo drivers used to jet fluids through nozzles at high velocities. In an alternate embodiment, actuator 216 is an electrostatic actuation electrode located underneath or immediately adjacent to cantilever 204. When a power source (not shown) applies an appropriate voltage to the actuation electrode, cantilever 204 lifts upward. In one embodiment, the electrostatic attraction between the actuation electrode and cantilever 204 pulls the cantilever flat against substrate 208. Besides electrostatic and piezo actuation, other methods for moving a cantilever rapidly between small distances may also be used, including heat induced movements and pressure induced movements.

In the example of FIG. 1, when a clear area is "printed", actuator 216 releases the cantilever moving cantilever tip 206 to the drum surface. Upon contact with the drum surface, a transitory current drains charge through the cantilever to a ground terminal. In alternate embodiments, the cantilever prints charge on a previously discharged drum surface. When "printing charge," a current carries charge from a charge source, through the cantilever, to the drum surface.

For high resolution images, each cantilever is typically quite small. For example, cantilever widths of less than 42 micrometers are typically used when depositing dots at 600 dots per inch. In order to achieve 1200 dpi resolution, a cantilever width of less than 24 micrometers is desired (1 inch divided by 1200). The cantilever should also be able to withstand rapid motion. Typical cantilever cycle speeds range between 1000 cycles per second and 10,000 cycles per second although other speeds may also be used. Embodiments are also possible where the cantilever continuously contacts the drum surface and the control circuit controls charge flow by adjusting an electrical connection at the base of cantilever 204.

Figure 3:
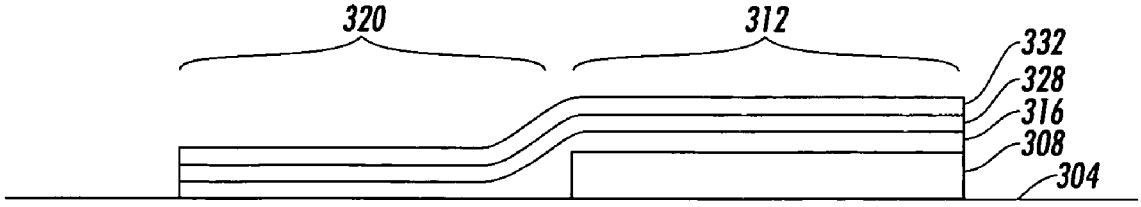
FIG. 3 shows one example of an intermediate structure used to form a stressed metal cantilever

Stressed metal techniques provide one method of forming cantilevers. FIG. 3 shows a structure used in the process of forming a stressed metal cantilever. Each cantilever may be formed by first depositing a release layer 308 over a substrate 304. Release layer 308 may be formed of an easily etched material such as titanium or silicon dioxide.

In FIG. 3, a first stressed metal layer 316 includes a release portion 312 and a fixed portion 320. Release portion 312 is deposited over release layer 308. Fixed portion 320 is deposited directly over substrate 304. Subsequent layers 328, 332 are deposited over first stressed metal layer 316. The stressed metal layers are typically made of a metal such as a chrome/molybdenum alloy, or titanium/tungsten alloy, or nickel among possible materials.

Each stressed metal layer is deposited at different temperatures and/or pressures. For example, each subsequent layer may be deposited at higher temperature or at a reduced pressure. Reducing pressure produces lower density metals. Thus lower layers such as layer 316 are denser than upper layers such as layer 332.

After metal deposition, an etchant, that etches the release material only, such as HF, etches away release layer 308. With the removal of release layer 308, the density differential between layers causes the metal layers to curl or curve upward and outward. The resulting structure forms a cantilever such as cantilever 204 of FIG. 2. A more detailed descriptions for forming such stressed metal structures is described in U.S. Pat. No. 5,613,861 by Don Smith entitled "Photolithographically Patterned Spring Contact" and also by U.S. Pat. No. 6,290,510 by David Fork et al. entitled "Spring Structure with Self-Aligned Release Material", both patents are hereby incorporated by reference in their entireties.

Each cantilever 204 terminates in a tip 228. Cantilever tips are optimized to provide sufficient electrical contact between the drum surface and cantilever. The contact should provide sufficient contact area to quickly transfer charge, yet the contact area should be kept small enough to avoid charge leakage with adjacent pixels.

Figure 4:
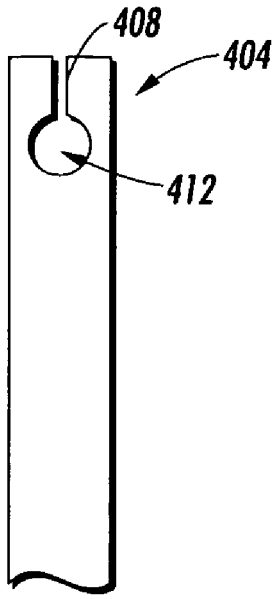
FIG. 4-5 show different cantilever tip shapes that may be used to add or remove charge from a dielectric substrate.
Figure 5:
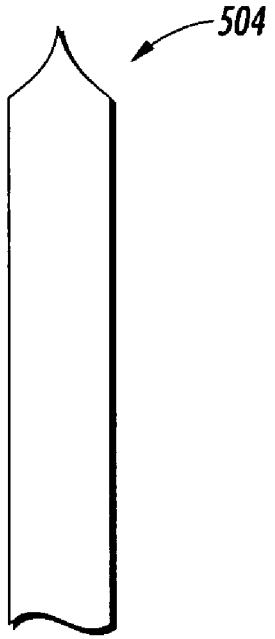

FIG. 4-5 shows example tip structures. FIG. 4 shows a flat tip 404 suitable for quickly transferring charge. Quick charge transfer makes tip 404 particularly useful in very high-speed systems. FIG. 5 shows a point tip 504 suitable for precise charge placement or removal. The pointed tip 504 is particularly suitable for very high-resolution systems.

Figure 6:
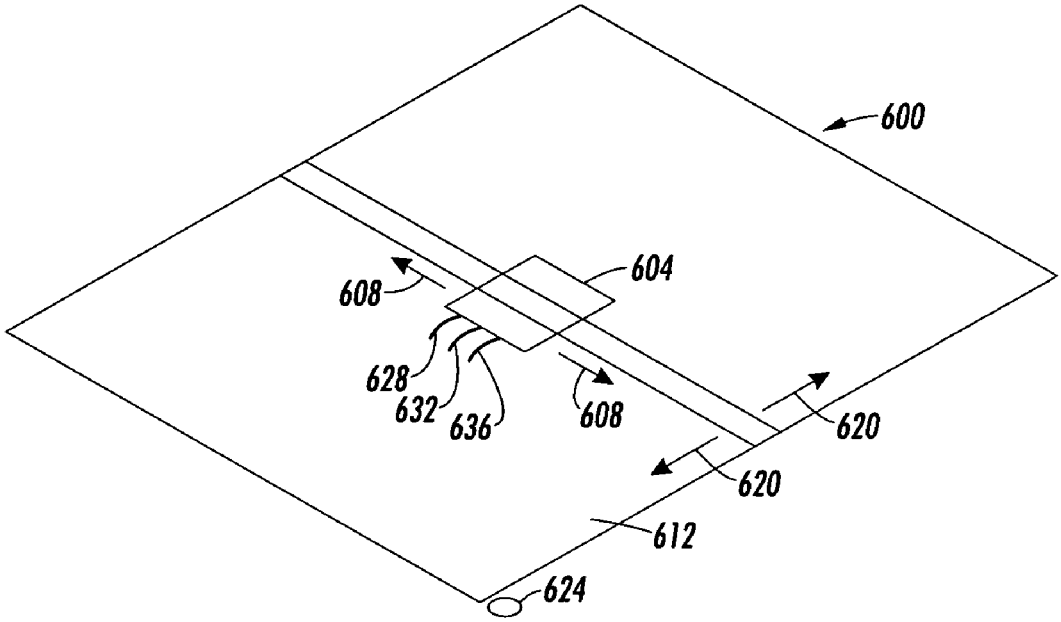
FIG. 6 shows an array of cantilevers installed on a print head that travels over a charged surface.

In a printing system, each cantilever typically operates in parallel with other cantilevers. FIG. 6 shows a structure 600 that includes a plurality of cantilevers mounted on a carriage head 604. During printing, carriage head 604 moves in a sideward direction 608 across the width of the template surface 612 being printed. In one embodiment, template surface 612 is the surface of a dielectric drum 108 of FIG. 1.

A processor 624 coordinates the movement of the carnage head 604 and drum surface 612. The relative motion of carriage head 604 and template surface 612 is coordinated such that substantially the entire printed area is covered by at least one cantilever in the plurality of cantilevers. The carriage head 604 speed is related to cantilever cycle speed. Thus for example, W the cycle speed of the cantilever is 500 cycles per second, and each pixel deposited by a cantilever is approximately 1 micron, then assuming only one cantilever, the carriage would move by a distance of 500 microns per second in a single direction.

Multiple cantilevers may be used to reduce carriage speed. FIG. 6 shows a first cantilever 628, a second cantilever 632 and a third cantilever 612 mounted on carriage head 636. Increasing the number of cantilevers by a value x results in a reduction in relative movement between surface 612 and cantilever by the value x. Because there are upper limits to the cycle speed of the cantilevers, high-speed systems typically have more than one cantilever.

One method of improving printing system reliability is to reduce the number of moving parts in a system. Thus, reducing or eliminating carriage head 604 movement increases printer system reliability and durability. In particular, fixing the carriage head eliminates motors used to move the carriage. Fixing the carriage head also reduces the probability of the carriage head coming loose during printer transport.

Figure 7:
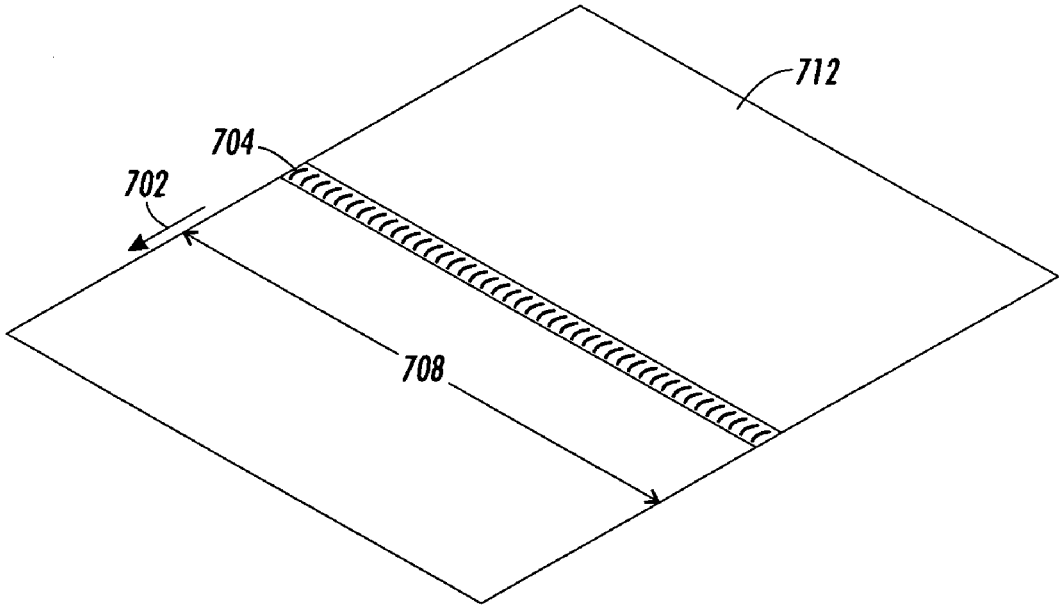
FIG. 7 shows an array of cantilevers spanning the width of an area of a dielectric that serves as a printing template.

Carriage head 604 movement may be eliminated by widening the carriage such that a plurality of cantilevers spans the entire width of the dielectric template surface. FIG. 7 shows a plurality of cantilevers 704 approximately spanning the width 708 of dielectric template surface 712. The number of cantilevers used depends on both the width of the area being printed and the desired resolution. For example, when printing an 8.5 inch wide paper at a 300 dots per inch resolution, the spanning carriage would have approximately 2550 cantilevers (8.5 inches×300 dots per inch). Each cantilever would deposit approximately one "dot" or one pixel. Higher print resolutions (e.g. 600 dots per inch) would result in correspondingly higher cantilever densities. Dedicated small printers, for example receipt printers, would result in fewer cantilevers needed to span the paper width.

Although FIG. 7 illustrates a plurality of cantilevers spanning the template width, a plurality of cantilevers may also be distributed along the template length. A lengthwise cantilever array may be used to further increase print speed. In the embodiment shown in FIG. 7, the template surface 716 is advanced along direction 702 at a rate equal to the cycle per second of the cantilever divided by the desired resolution. Thus, a 900 cycle per second cantilever movement divided by a resolution of 300 dots per inch results in a paper speed of approximately 3 inches per second. Increasing the number of cantilevers along the template length proportionally increases the print speed and thus proportionately reduces the time to prepare the template for printing.

Although the prior description describes an approximate line of cantilevers spanning a template width, the cantilevers may also be staggered or otherwise arranged in a pattern. Control electronics operating the cantilevers compensates for cantilever offsets during image output. For example, if a staggered cantilever is offset a distance "x" after a line of cantilevers, the control electronics waits until the paper advances the distance "x" before activating the staggered cantilever.

In the embodiment of FIG. 6 and FIG. 7, an addressing system independently addresses each cantilever. When electrodes individually actuate each cantilever, electrostatic cross talk can interfere with the addressing of adjacent cantilevers. One way to reduce the cross talk effects is to operate the cantilevers in a normally up mode instead of a normally down mode. In a normally up mode, the non-printing cantilevers normally press up against the actuator electrode instead of down against the template surface.

Normally up modes reduce the voltage differentials between adjacent electrodes. These voltage reductions minimize the number of expensive high voltage driver chips in the printing system. The lower voltage differentials also reduce cross talk between adjacent cantilevers. In a normally up mode embodiment, high voltage drive electronics apply a direct current (DC) bias to maintain the cantilevers in the up position. The DC bias takes advantage of the substantial hysteresis typical in electrostatic actuation cantilevers to minimize voltage fluctuations applied to the electrodes.

Figure 8:
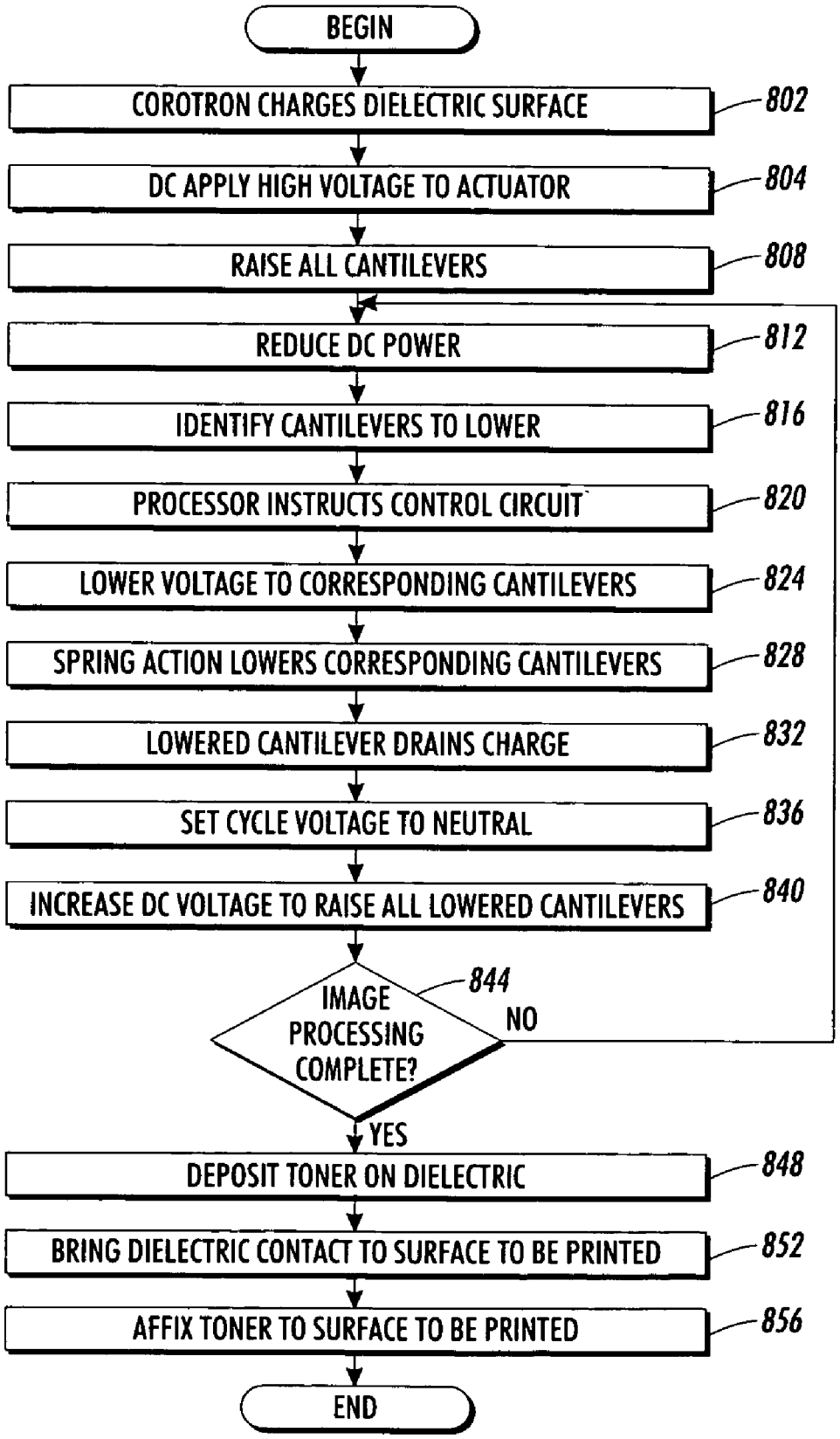
FIG. 8 is a flow chart describing one method of applying power to an electrostatic actuator in the plurality of charge control cantilevers described in FIGS. 6 and 7.

FIG. 8 is a flow chart that shows one example of a voltage sequence applied to a controlling electrode to control a plurality of cantilevers. In block 802, a corotron applies a charge to all pixels on a dielectric template surface 628. In block 804, a DC power source 626 of FIG. 6 applies a high voltage to all cantilevers. The high voltage raises all cantilevers to an upward position as described in block 808. The upward position keeps the cantilevers away from the template surface 628.

In block 812, the DC output from the DC power source 626 is slightly reduced. The reduced DC voltage is sufficient to maintain the cantilevers in the up position but insufficient to raise a downward positioned cantilever.

When printing, a processor determines in block 816 which cantilevers to lower. Each lowered cantilever results in a corresponding drain of charge from a pixel. In the described embodiment of a two color printer system (typically black and white) the determination of whether to lower a cantilever depends on whether to remove charge from a particular location. Areas that have no charge will not attract toner and thus will appear blank (or white when printing on a white sheet of paper). In a multi-pass color printing system, the decision on whether to place charge may also depend on which color is being printed in the particular pass, the cantilever will be lowered wherever there is an absence of the color being printed in the corresponding pass.

In block, 820, processor 634 transmits instructions on which cantilever to lower to a control circuit. In block 824, the control circuit reduces the actuator voltage to cantilevers that should be lowered. Spring action or other stresses in the cantilever lowers the corresponding cantilevers in block 828. In the described embodiment, the lower voltage "allows" spring action to lower the cantilever, the voltage itself does not lower the cantilever although in alternate embodiments, a voltage may be used to lower the cantilever.

In block 832, each lowered cantilever drains charge from the pixel being contacted. These "blank pixels" will eventually correspond to unprinted areas of a template surface. The charge distribution formed by all the cantilevers over time forms a charge image on the template that is converted to a printed image on a printed surface.

After printing pixels, the cycling voltage source is set to a neutral position in block 836. In one embodiment, "neutral" may be an off state. The voltage output of the DC power source increases in block 840 to raise all previously lowered cantilevers. In block 844, a processor determines whether the printing of the image is complete. Image printing on the template is typically complete when charge corresponding to all pixels of the image have been recorded on the template. If printing of the image has not been completed, the process is repeated starting from block 812.

When charge arrangement has been completed, a toner is deposited over the template surface in block 848. The toner adheres to charged portions of the template. The template surface is then brought into contact with a surface to be printed in block 852. When in contact, the template toner pattern is transferred to the surface to be printed.

After image transfer, the toner representation of the image is affixed to the surface to be printed in 856. Affixing of the toner may be done using some combination of pressure, heat and chemical fusers. Such affixing techniques are well known in the art.

Although flow chart 800 describes one method of controlling the cantilevers to deposit charge, other methods may be used. For example, one minor change uses a second power supply to maintain the up cantilevers in an up position and to lower the DC power source voltage. Thus only cantilevers not coupled to the second power supply are lowered.

Normally down state printing systems are also possible. In a normally down state printing system, cantilevers that are not removing charge during a cycle remain coupled between a source of charge and the surface being printed. When charge needs to be removed, a switch connects the fixed portion of the cantilever to ground. Other possible variations include cantilevers that place charge instead of remove charge and/or cantilevers that both place and remove charge Although the preceding description describes the distribution and affixing of toner, other materials may be distributed and affixed. For example, the described system and techniques may be used to control distribution of a pharmaceutical product. In such an embodiment, the cantilever controlled charge distribution controls distribution of a pharmaceutical product onto a surface. Subdivisions of the surface are deposited into containers such as pills or capsules. Because the quantity of pharmaceutical product can be very precisely controlled, the quantity in each subdivision can be carefully controlled to match a dosage that is adequate to treat a particular medical condition.

The preceding description includes a number of details that are included to facilitate understanding of various techniques and serve as example implementations of the invention. However, such details should not be used to limit the invention. For example, duty cycles, tip geometries, cantilever fabrication techniques and voltage sequences have been described. These details are provided by way of example, and should not be used to limit the invention. Instead, the invention should only be limited to the claims as originally presented and as they may be amended, including variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A material distribution system to distribute a material comprising:

a first cantilever that includes at least one end that is raised and lowered to alter charge distribution on a dielectric surface; and, a dispenser apparatus to deposit a material over the dielectric surface such that the charge on the dielectric surface controls the material distribution over the dielectric surface.

2. The system of claim 1 wherein the first cantilever couples to a charge source, the cantilever to transfer charge from the charge source to the dielectric surface when the cantilever is in contact with the dielectric surface.

3. The system of claim 1 wherein the cantilever couples to ground, the cantilever to transfer charge from the dielectric surface to ground when the cantilever is in contact with the dielectric surface.

4. The system of claim 1 wherein the material deposited is a marking material.

5. The system of claim 4 wherein the marking material is a toner.

6. The system of claim 1 further comprising:

an electrode positioned in close proximity to the first cantilever such that a voltage on the electrode creates an electric field that move a tip of the first cantilever away from the dielectric surface.

7. The system of claim 1 further comprising:

a piezo-electric coupled to the cantilever, the piezo-electric to control movement of a tip of the first cantilever.

8. The system of claim 1 further comprising:

a second cantilever working in conjunction with the first cantilever to alter the charge distribution over the dielectric surface.

9. The system of claim 1 further comprising:

an array of cantilevers working in conjunction with the first cantilever to alter the charge distribution over the dielectric surface.

10. The system of claim 9 further comprising:

control electronics that applies voltages to an array of electrodes, each electrode to generate an electric field that controls the motion of a corresponding electrode in the array of cantilevers.

11. The system of claim 10 wherein the control electronics applies a high voltage to raise all cantilevers from the dielectric and then selectively lowers voltages to selected electrodes, the lowered voltage to lower corresponding cantilevers.

12. The system of claim 1 wherein the material deposited is a marking material, the system further comprising:

an affixing system to transfer the marking material to a surface to be printed, the affixing system to affix the marking material to the surface to be printed.

13. The system of claim 12 wherein the affixing system uses heat and a fuser to affix the marking material to the surface to be printed.

14. The system of claim 1 wherein the cantilever has a length of less than 2000 microns.

15. The system of claim 1 wherein the cantilever is a stressed bi-metal.

16. The system of claim 1 wherein the dielectric surface is the surface of a drum that transfers the deposited material to a second surface.

17. A direct xerographic printing system comprising:

a first cantilever including at least a first end that is raised and lowered to alter a charge distribution on a dielectric surface; and, a dispenser apparatus to deposit toner over the dielectric surface, the toner to approximately match the charge distribution.

18. The direct xerographic printing system of claim 17 wherein the dielectric surface is the surface of a drum.

19. The direct xerographic printing system of claim 17 further comprising:

an affixing system to transfer the toner from the dielectric surface to a surface to be printed, the affixing system to affix the toner to the surface to be printed.

20. The direct xerographic printing system of claim 17 further comprising:

a plurality of cantilevers working in conjunction with the first cantilever to alter the charge distribution on the dielectric surface.

21. A system for fabricating a pharmaceutical product comprising:

a cantilever including at least a first end that can be raised and lowered to control a distribution of charge on a dielectric surface; and, a dispenser apparatus to deposit the pharmaceutical product over the dielectric surface such that the distribution of charge controls the distribution of pharmaceutical product over the dielectric surface.

22. The system of claim 21 wherein a distribution of pharmaceutical product over a predetermined area approximately matches the dosage to be taken for treatment of a medical condition.

23. The system of claim 2 wherein the cantilever is coupled to the charge source only when the cantilever is not in contact with the dielectric.

24. The system of claim 2 wherein the cantilever is continuously coupled to the charge source.

25. The system of claim 3 wherein the cantilever is coupled to the ground only when the cantilever is not in contact with the dielectric.

26. The system of claim 3 wherein the cantilever is continuously coupled to the ground.

* * * * *